United States Patent [19]

Badali

[11] 4,213,262

[45] Jul. 22, 1980

[54] BOX MAGAZINE FOLLOWER SYSTEM

[75] Inventor: Joseph A. Badali, Mountain Green, Utah

[73] Assignee: Browning Arms Company, Morgan, Utah

[21] Appl. No.: 943,700

[22] Filed: Sep. 19, 1978

[51] Int. Cl.[3] ..... F41C 25/02

[52] U.S. Cl. ..... 42/50

[58] Field of Search ..... 42/50, 18, 22, 6

[56] References Cited

U.S. PATENT DOCUMENTS 462,298 11/1891 Bruce ..... 42/18

487,432 12/1892 Sponsel ..... 42/50

FOREIGN PATENT DOCUMENTS 330493 10/1935 Italy ..... 42/50

*Primary Examiner*—Charles T. Jordan

*Attorney, Agent, or Firm*—Trask & Britt

[57] ABSTRACT

A box magazine follower system is constructed with spring struts pivotally connected at an intersection to form an "X" configuration. A magazine follower is supported by the upper ends of the struts to move vertically within the magazine box while maintaining an approximately horizontal orientation.

4 Claims, 2 Drawing Figures

BOX MAGAZINE FOLLOWER SYSTEM

BACKGROUND OF THE INVENTION

1. Field

This invention relates to magazine follower systems for firearms and provides an improved such system particularly adapted for use in box magazines of the type commonly used for bolt action rifles.

2. State of the Art

Box magazines are often installed in firearms, especially rifles. Shells or cartridges are "stuffed" into a magazine box carried near the receiver of the gun, and are subsequently fed one-by-one from the magazine box into the receiver by operation of repeating mechanisms of various types. These mechanisms are most often actuated by a bolt.

A box magazine of the prior art typically includes a box with a magazine follower mechanism installed therein. The follower includes an element, usually referred to as a magazine ramp, spring biased toward the open top of the box. Shells are loaded into the box atop the ramp, thereby pushing the follower down against a magazine spring. The stored energy of the magazine spring urges the stored cartridges from the magazine box into the receiver as the repeating mechanism permits. The magazine spring in common use is shaped as a "W" or "Z" and is usually connected at one end of the ramp so that the ramp can be tilted. Tilting of the ramp is desirable to facilitate entry of a cartridge into the box. Care is required, however, that pressure be applied near the center of each cartridge loaded into the magazine. Otherwise the cartridge tends to tip within the box. If the cartridges tip beyond a very limited extent, they tend to bind within the box making loading difficult and interferring with proper repeating action of the firearm.

SUMMARY OF THE INVENTION

The present invention provides a magazine follower system which avoids the problems of the prior art systems. A pair of magazine spring struts is installed within a magazine box in a crossed ("X") configuration. The follower, specifically the magazine ramp, is supported by the upper ends of the struts such that it rides vertically up and down within the magazine box without tipping. Thus, a cartridge may be pressed down into the magazine without particular attention to the position along the cartridge where pressure is applied. The ramp may be linked to the struts in a fashion which permits the entry end to tilt slightly, thereby facilitating each entry of a fresh cartridge. Such tilting is limited, however, to avoid binding of a cartridge in the magazine.

BRIEF DESCRIPTION OF THE DRAWINGS

In the drawings, which illustrate what is currently regarded as the best mode for carrying out the invention.

DESCRIPTION OF THE ILLUSTRATED EMBODIMENT

Figure 1:
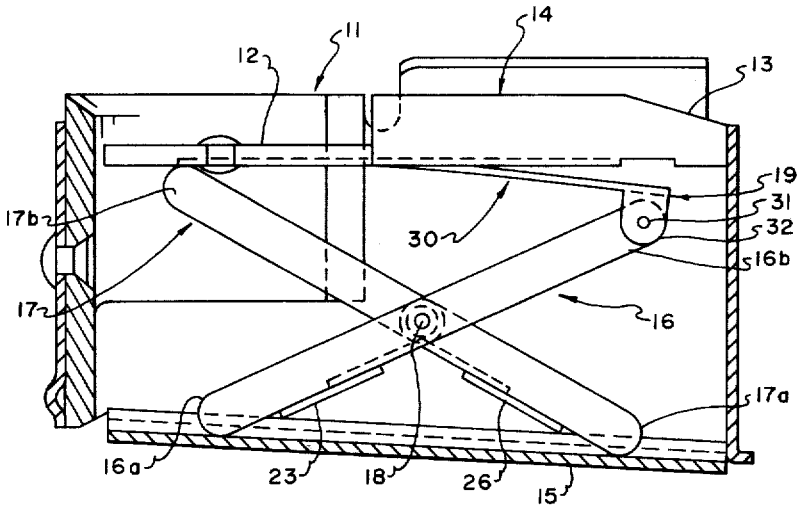
FIG. 1 is a view in side elevation of the internal components of the assembly of this invention mounted within a magazine box, the box being illustrated in section.

As illustrated, a magazine box 11 of conventional design is shown removed from a firearm, typically a bolt action rifle (not shown). A magazine ramp 12, also conventional, is mounted to slide vertically within the box 11. The ramp 12, together with an entry guide 13, constitute a magazine follower 14. In practice, as cartridges are loaded onto the ramp 12, the follower 14 is depressed down towards a floor plate 15 of the box 11. The stored shells are held in the magazine and fed into the receiver of the firearm by conventional means forming no part of this invention.

A pair of magazine struts 16, 17 are placed within the magazine box 11. These struts are oriented diagonally within the box 11 as shown to effect an intersection, and they are pivotally connected by an axle 18 at this intersection. The first, or outer, strut 16 has a lower end **16*a* which bears on the floor plate 15, and the second, or inner, strut 17 has a corresponding lower end 17*a* which bears on the floor plate 15. As illustrated, these ends 16*a*, 17*a* are both free to slide longitudinally upon the floor plate 15, although one of them may be restrained, if desired, provided the strut is free to pivot from the restrained end. The upper end of one of the struts (in the illustrated instance, the upper end 16*b* of the outer strut 16), is connected through linkage, indicated generally 19, to the follower 14. The upper end 17*b* of the outer strut 17 supports the follower 14** in sliding engagement.

The terms "inner" strut and "outer" strut are used herein consistent with the specific structure illustrated. Other strut configurations are within contemplation and can readily be devised by those skilled in the art. Moreover, in this disclosure and the claims, the invention is described as though the magazine box is oriented with the floor plate 15 approximately horizontal and the box 11 oriented vertically as illustrated in FIG. 1. Ordinarily, these components are so oriented with respect to a firearm, assuming that the top of the firearm is regarded as "up" and the barrel of the firearm is regarded as "horizontal". Terms such as "horizontal", "vertical", "up", "down", and the like are used within this frame of reference, although it is understood that in practice, a firearm may be held in an orientation such that the magazine box 11 is non-vertical and/or the floor plate 15 is non-horizontal with respect to the earth.

Figure 2:
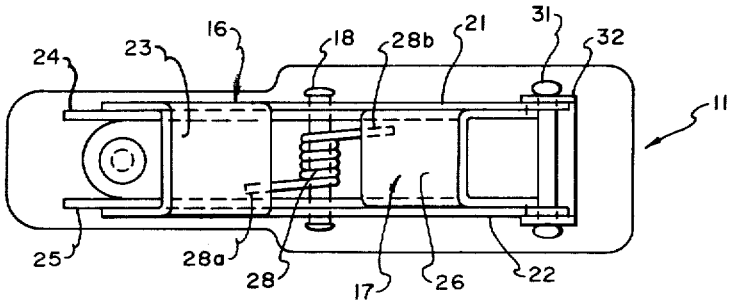
FIG. 2 is a bottom view of some of the internal components shown by FIG. 1, with portions of the components shown in phantom lines.

Referring to FIG. 2, the first (outer) strut 16 is formed with approximately parallel side members 21, 22 rigidly connected at corresponding edges by a spring reaction member 23. The second (inner) strut 17 is also formed with approximately parallel side members 24, 25 similarly connected by a spring reaction member 26 at a spacing permitting the strut 17 to be straddled by the side members 21, 22 of the strut 16. In this fashion, the struts 16, 17 may be pivoted on axle 18 so that the strut 17 is substantially (i.e., nearly completely) contained within the strut 16 when the follower assembly is in collapsed condition. (I.e., the magazine box 11 is filled or "loaded" with cartridges.) The follower assembly is shown in collapsed condition in FIG. 2 and in open (the magazine box 11 is empty) condition in FIG. 1. A spring 28 is coiled around the axle 18 with its opposite spring extensions **28*a*, 28*b* retained by the respective reaction members 23, 26. The spring 28 thus biases the struts to open condition (FIG. 1). That is, the corresponding upper strut ends 16*b*, 17*b* are urged towards each other, thereby lifting the magazine follower 14 upward within the magazine box 11**.

The magazine follower 14 is illustrated as comprising a magazine ramp 12 oriented approximately horizontally within the magazine box 11. It is usually preferred that the receiving end (carrying entry guide 13) of the ramp 12 be mounted to permit its depression against spring pressure when a cartridge is initially inserted in the magazine. Accordingly, rather than a direct pivot connection between an upper strut end and the follower, a flat magazine spring 30 links the upper strut end **16*b* adjacent the guide 13 to the opposite end of the ramp 12; i.e., the portion of the ramp 12 in the vicinity of the upper strut end 17*b*. The spring 30 biases the ramp 12 into an approximately horizontal orientation, but permits tilting of the guide 13 down in response to insertion of a cartridge into the box 11. Tilting is limited by contact of the guide 13 by the strut end 16*b*, thereby avoiding the binding inherent in the device of the prior art. The spring 30 is connected to the strut 16 by a pin 31 through spring dogs 32 which straddle the upper strut end 16*b***.

Reference herein to specific details of the illustrated embodiment should not be taken as limiting the scope of the appended claims which themselves recite those features regarded as essential to the invention.

I claim:

1. A magazine follower assembly, comprising:

a magazine box adapted to receive cartridges through its top and including a floor plate;

a first strut oriented diagonally within said magazine box with a lower end slidably supported by said floor plate and an upper end;

a second strut oriented diagonally within said magazine to effect an intersection with said first strut, pivotally connected to said first strut at said intersection, said second strut also having a lower end supported by said floor plate and an upper end;

spring means biasing said struts to pivot so that their corresponding upper ends move toward each other, thereby causing said upper ends to lift with respect to said floor plate; and a follower member, including a first element oriented approximately horizontally with respect to said magazine box, and a second element pivotally connected to the upper end of one said strut and connected to said first element in the vicinity of the upper end of the other said strut, within said magazine box such that its orientation remains approximately horizontal within said box when it is pushed down towards said floor plate.

2. A magazine follower assembly according to claim 1 wherein said first element constitutes a magazine ramp carrying an entry guide at one end and said second element constitutes a flat spring arranged to permit the end of the ramp carrying said guide to be tilted down within said magazine box by a cartridge inserted into said box.

3. A magazine follower according to claim 1 wherein each said strut is constructed with approximately parallel spaced side elements, and the said side elements of one said strut (outer strut) straddle the side elements of the other said strut (inner strut).

4. A magazine follower according to claim 3 wherein said struts are configurated such that when said magazine box is loaded with cartridges, said follower assembly is urged to a collapsed condition wherein said inner strut is substantially contained within said outer strut.

* * * * *